US005943977A

United States Patent [19]

Womack et al.

[11] Patent Number: 5,943,977

[45] **Date of Patent: *Aug. 31, 1999**

[54] CONVERTIBLE WATER SKI TOW APPARATUS

[76] Inventors: Scott H. Womack, 5800 Eubank N.E. #2435; Ernest E. Nellos, 3431 Dakota N.E., both of Albuquerque, N.Mex. 87110

[ * ] Notice: This patent issued on a continued prosecution application filed under 37 CFR 1.53(d), and is subject to the twenty year patent term provisions of 35 U.S.C. 154(a)(2).

[21] Appl. No.: 08/997,206

[22] Filed: Dec. 23, 1997

Related U.S. Application Data

[60] Provisional application No. 60/033,937, Dec. 23, 1996.

[51] Int. Cl.[6] ..... B63H 21/56

[52] U.S. Cl. ..... 114/242; 441/69

[58] Field of Search ..... 114/242, 253, 114/343; 441/68, 69; 434/253

[56] References Cited

U.S. PATENT DOCUMENTS 3,303,813 2/1967 Collins .
3,326,175 6/1967 Baker .
3,390,658 7/1968 Jelks .
4,480,577 11/1984 Naypaver .
5,000,109 3/1991 Anderson ..... 114/242
5,241,921 9/1993 Sadlak ..... 114/253

*Primary Examiner*—Ed L. Swinehart

[57] ABSTRACT

A convertible water ski tow apparatus for a ski boat is disclosed. The apparatus includes a main tube and a bracket which are attachable to the conventional fixed ski tow pylon found in virtually all ski boats. The bracket affixes the main tube to the tow pylon and permits the main tube to positioned in either of two positions. In an upright position, the main tube acts as a vertical extension of the pylon, so as to facilitate and enhance wakejumping on conventional wakeboards, water skis, or other devices. In a horizontally extending position, the main tube extends outwardly from the boat, where it can be used for instructional skiing, barefoot skiing, and other applications. The apparatus is readily convertible in the field from one position to another, and is stabilized with adjustable rigging extending to the bow of the boat.

7 Claims, 9 Drawing Sheets

CONVERTIBLE WATER SKI TOW APPARATUS

BACKGROUND OF THE INVENTION

This application claims the benefit of U.S. provisional application Ser. No. 60/033,937, entitled "Variable Angle, Contoured Boom-Pylon Apparatus", filed Dec. 23, 1996 by Scott H. Womack and Ernest E. Nellos.

The invention described and claimed herein is generally related to water skiing devices and equipment. More particularly, the present invention is related to enhancements to the conventional tow pylons commonly found on ski boats, by which a ski tow rope is attached to the boat.

Conventional ski tow pylons are provided on virtually all commercially available ski boats. Such pylons extend upwardly from the rear of the boat have been used for many years for conventional water ski towing.

Special purpose ski tow devices are increasingly popular. In particular, vertical pylon extension devices are used to provide an upward tow angle to the tow rope, thereby facilitating and enhancing the effects of wake jumping on skis, wakeboards, or other water ski devices.

Laterally extending ski tow booms are also well known. They typically extend outwardly and generally horizontally from the ski boat, and may be either gripped directly by a skier, or may be used to tow a skier by means of a conventional tow rope. Such booms are desirable, for example, for instructional purposes, because they allow a novice skier to be positioned near the boat, where he or she can receive verbal instructions and coaching from an instructor aboard the boat. They are also desirable because the novice skier can directly grip the boom, as opposed to a ski rope, thereby obtaining greater stability and security. Further, lateral ski tow booms are desirable for certain specialty applications, such as barefoot skiing, because the skier can ski forward of the wake of the boat, where the water is smoother and undisturbed by the wake.

Accordingly, it is the object and purpose of the present invention to provide an apparatus that is convertible in function between that of an elevated ski tow pylon and that of a laterally extending ski tow boom.

More particularly, it is also an object and purpose of the present invention to provide an apparatus which is readily convertible in the field between an extended pylon position and a laterally extended boom position.

It is a further object and purpose of the present invention to provide an apparatus that attains the foregoing objects and purposes and which is compatible with, and mountable to, the conventional fixed tow pylon commonly used in ski boats.

SUMMARY OF THE INVENTION

In accordance with the present invention, there is provided a convertible water ski tow apparatus for a boat having an upright ski tow pylon. The apparatus includes a main tube, a mounting bracket, and associated support rigging. The mounting bracket includes a pair of opposing plates which are configured to securely engage the upright ski tow pylon when they are clamped about the pylon. The bracket further includes a male connector pivotably connected to the plates and extending therefrom so as to swing in a vertical plane. The lower end of the main tube is sized to slide over the pylon in a first position to engage the mounting bracket and to function as an upright extension of the pylon. In this position the main tube functions as an extended pylon and can be used, for example, to facilitate and enhance wake jumping. Alternatively, the lower end of the main tube can be slid over the male connector, in a second position, so as to extend generally horizontally over the gunnel of the boat and to function as a ski tow boom. In this position the main tube can be used for instructional skiing purposes, or for barefoot skiing, and for other applications.

The support rigging extends from the upper end of the main tube to the bow of the boat, and is adjustable in tension and length so as to stabilize the main tube in either the upright position or the horizontal position.

In a preferred embodiment, the main tube includes a diagonal offset center section, which functions in a dual capacity to accommodate certain commonly used sun shades, and also to allow the main tube to be adjusted to a desired height above the water when in the horizontally extending position.

These and other aspects of the present invention will be more apparent upon consideration of the accompanying drawings and the following detailed description.

BRIEF DESCRIPTION OF THE DRAWINGS

The present invention will be best understood by reference to the detailed description set forth below, taken with the accompanying drawings.

In the drawings.

DETAILED DESCRIPTION

Figure 2:
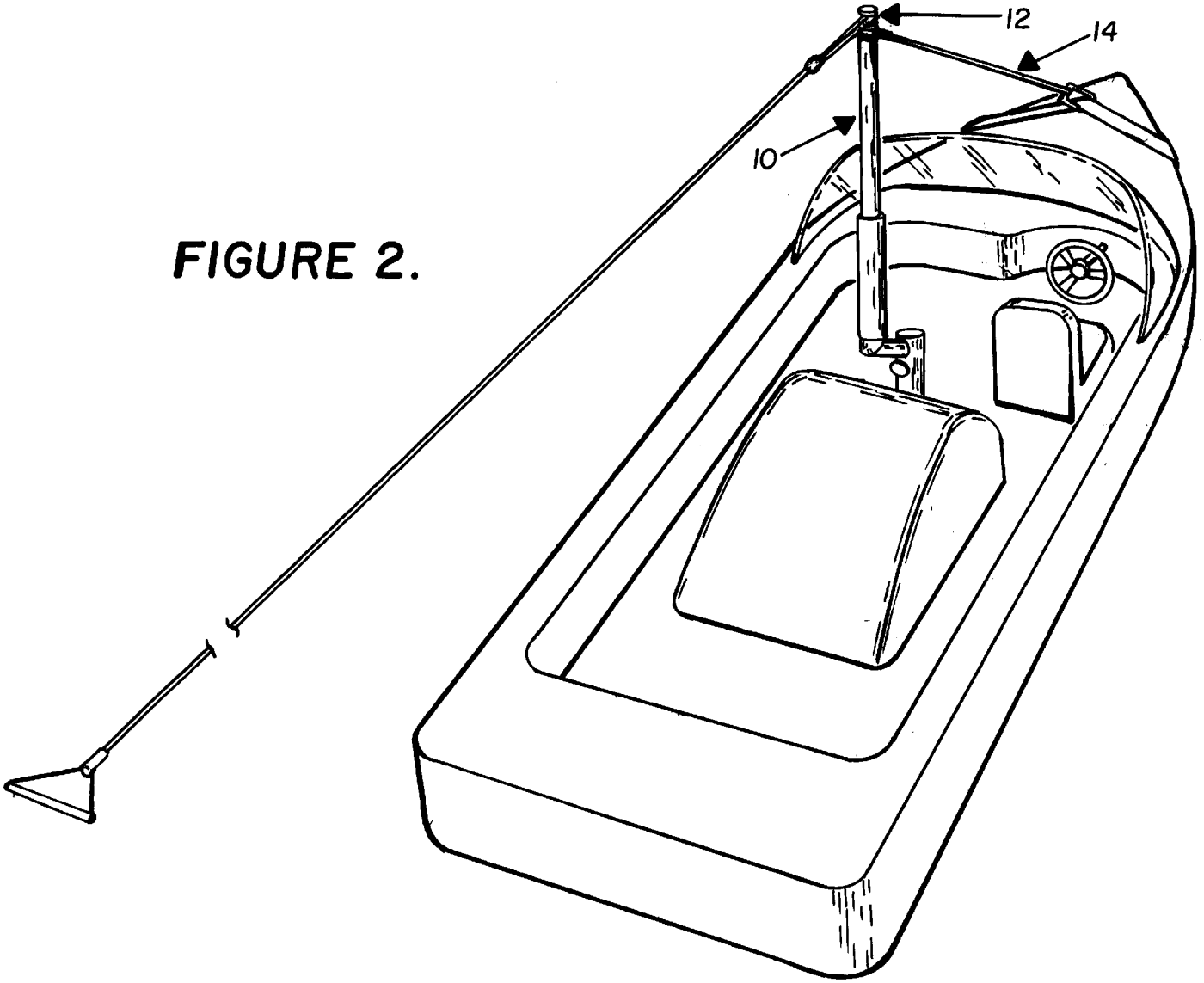
FIG. 2 illustrates the ski tow apparatus of the present invention positioned in the upright, vertically extended position, where it functions as an vertically extended pylon.
Figure 3:
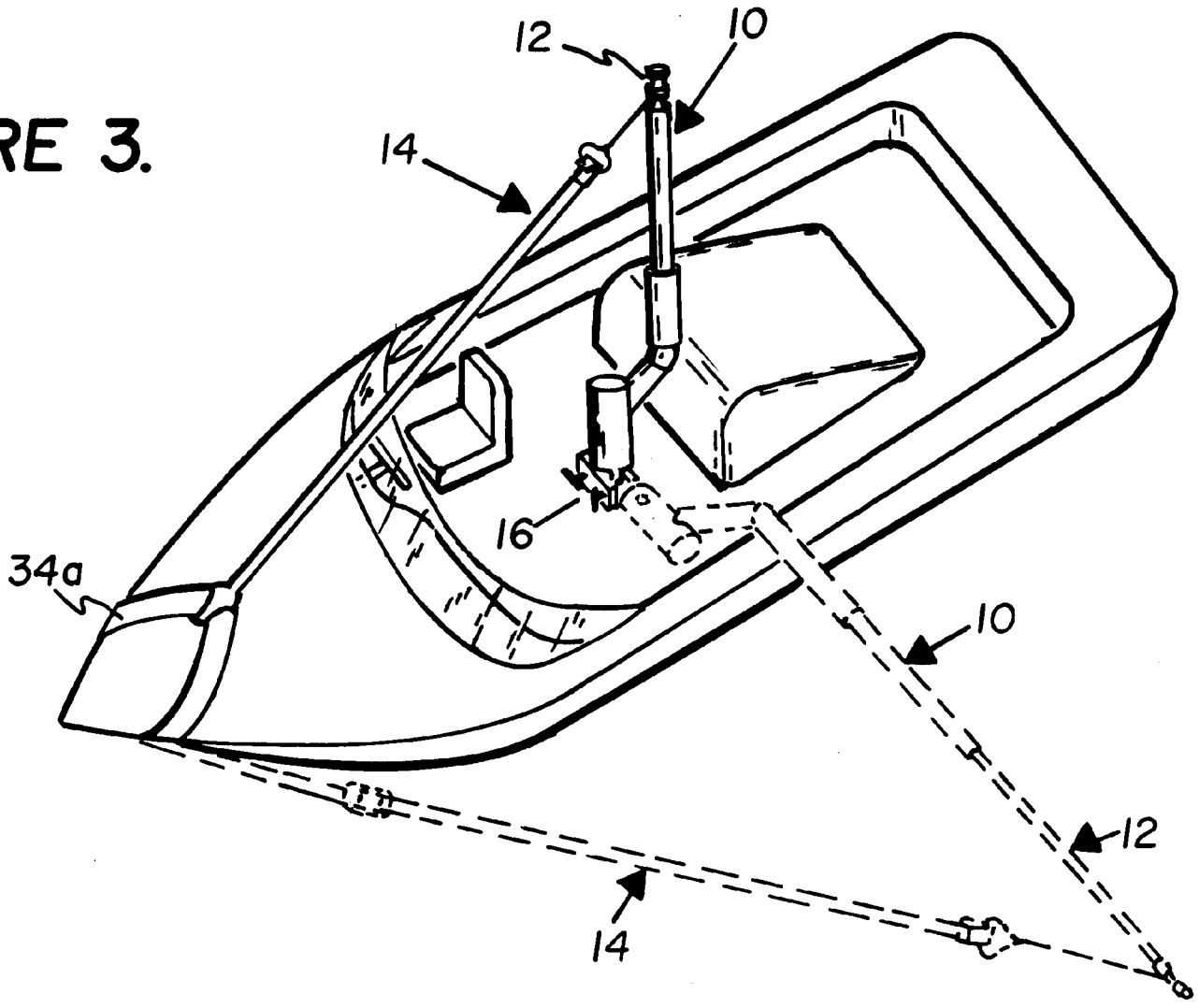
FIG. 3 is a composite view, illustrate the ski tow apparatus of the present invention in both the upright and horizontally extended positions of FIGS. 1 and 2.
Figure 4:
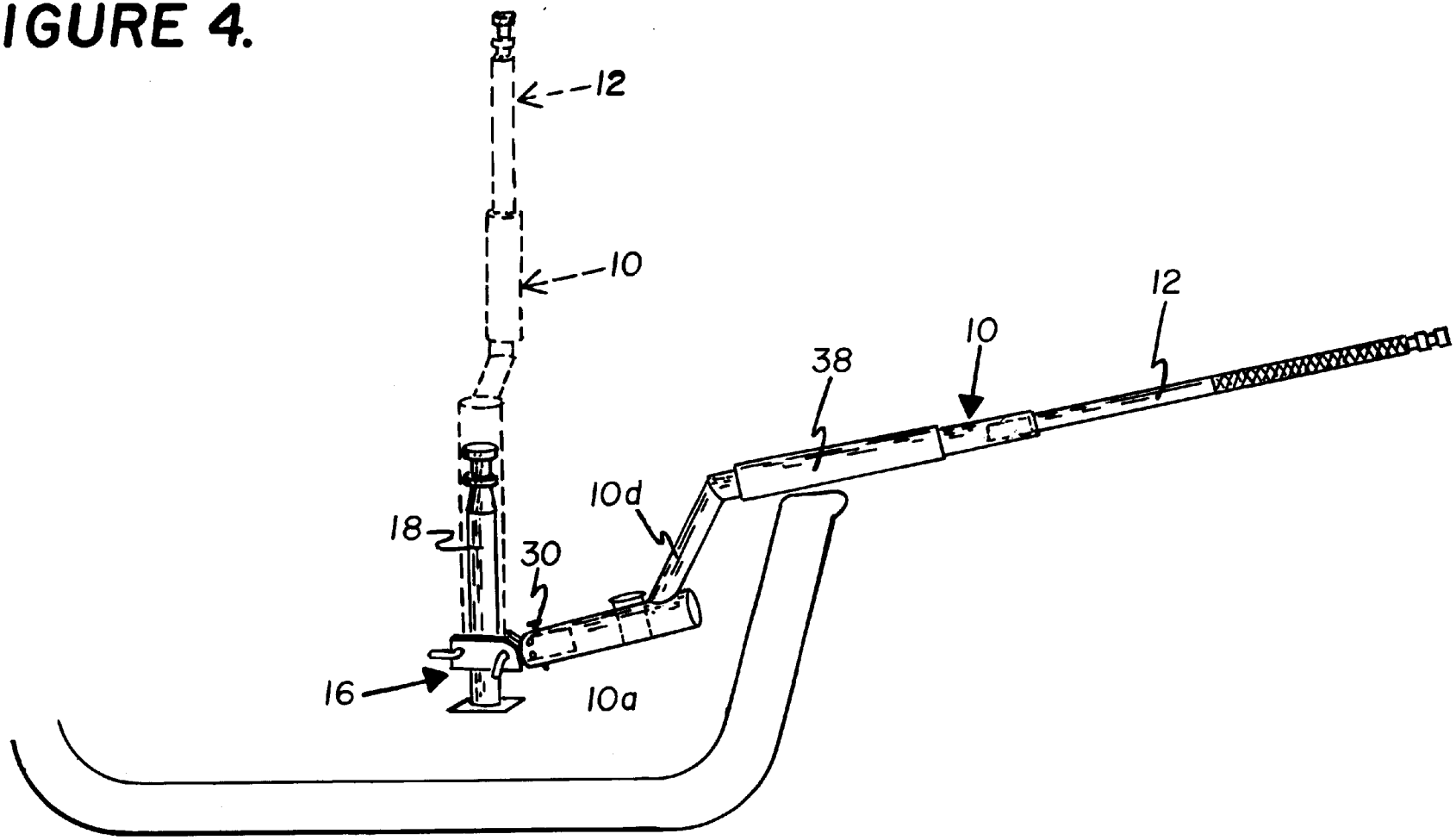
FIG. 4 is a cross sectional view of the boat, illustrating the ski tow apparatus in the upright position as installed on a conventional sky tow pylon.
Figure 5:
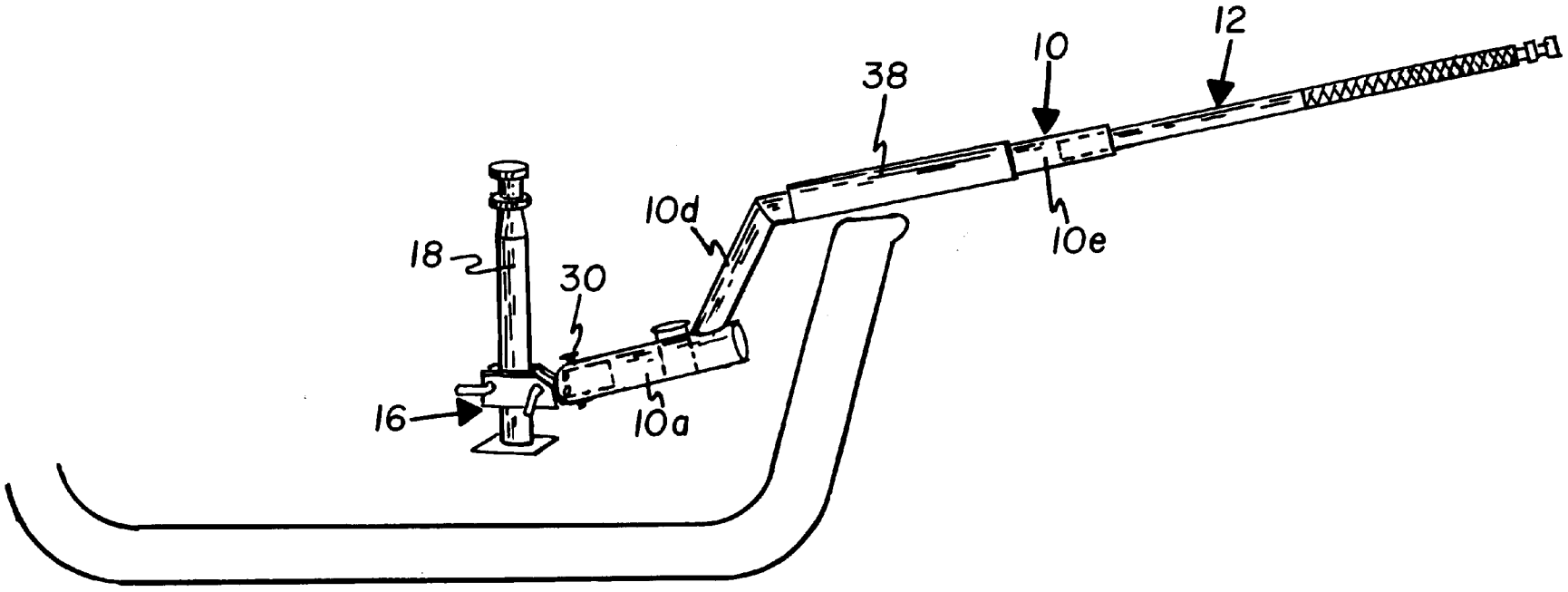
FIG. 5 is a cross sectional view of the boat, illustrating the ski tow apparatus in the horizontally extended position to function as a ski tow boom.

Referring first to FIGS. 1 through 5, there is illustrated a preferred embodiment of the convertible ski tow apparatus of the present invention, as it is installed in a conventional ski boat. The apparatus includes a main tube 10, an extension rod 12, support rigging 14, and a mounting bracket 16 (FIG. 4). The main tube 10 includes a lower tubular section 10*a* which is sized to fit snugly over a standard 2½ inch cylindrical ski tow pylon 18. The tow pylon 18 is conventional and forms no part of the present invention. The lower section 10*a* is sized in length just sufficient to accommodate the full length of the tow pylon 18. The lower end of the lower tubular section 10*a* includes a pair of opposing ears 10*b* and 10*c*, which engage the mounting bracket 16 as further described below.

The axis of the main tube 10 is offset by a diagonal section 10*d*, which separates the lower section 10*a* from an extended upper section 10*e*. Upper section 10*e* is thus parallel to lower section 10*a*, but offset therefrom by the diagonal section 10*d*. One function of the diagonal section 10*d* is to allow the main tube to clear a type of sunshade commonly used on ski boats, known as a "Bimini" sun shade, thereby avoiding the necessity of modifying the sunshade to accommodate the main tube in its upright position.

Figure 10:
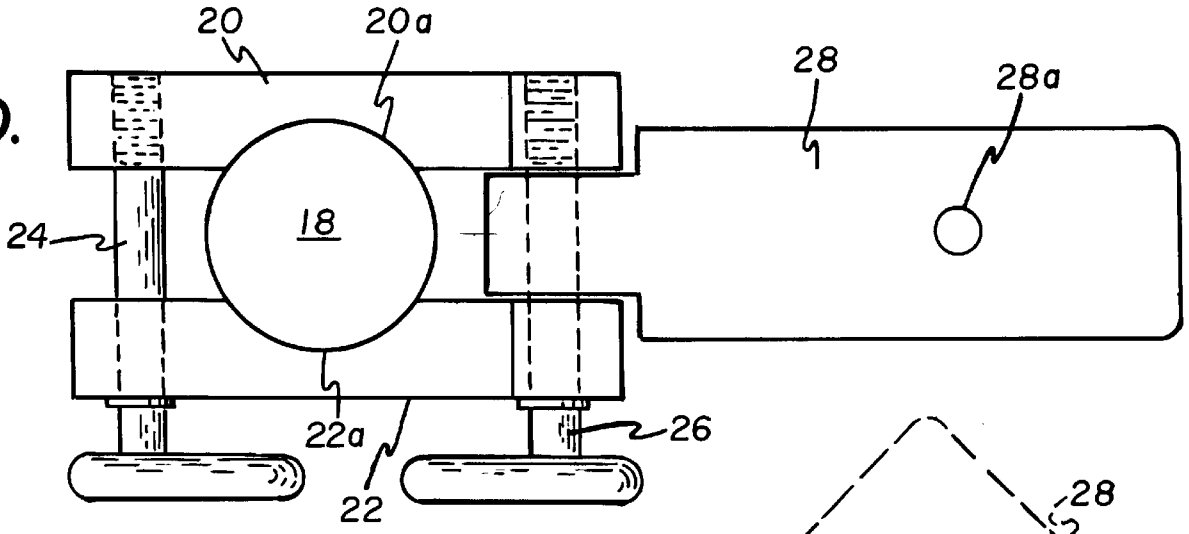
FIG. 10 is a top view of the mounting bracket of FIG. 9.
Figure 11:
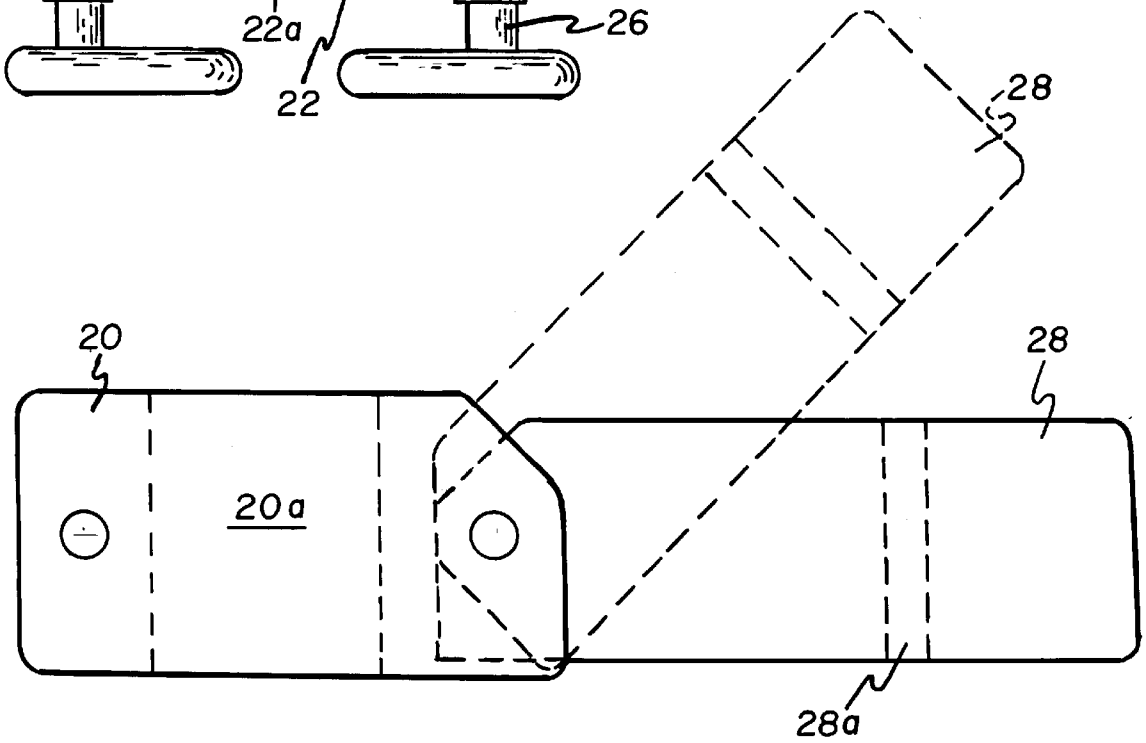
FIG. 11 is a side view of the mounting bracket of FIG. 9.

The mounting bracket 16 (FIGS. 10 and 11) includes two opposing plates 20 and 22, which include opposing hemicylindrical surfaces 20*a* and 22*a*. When installed on the pylon 18, the two opposing plates 20 and 22 are clamped about the lower end of the pylon 18 by means of a pair of threaded L-bolts 24 and 26 (FIG. 10), with the hemicylindrical surfaces 20*a* and 22*a* being engaged against and partially encircling the pylon 18. The hemicylindrical surfaces 20*a* and 22*a* may be coated with a suitable elastomer or other polymer to attain adequate friction with the pylon 18 and to minimize damage to the surface of the pylon 18.

Figure 9:
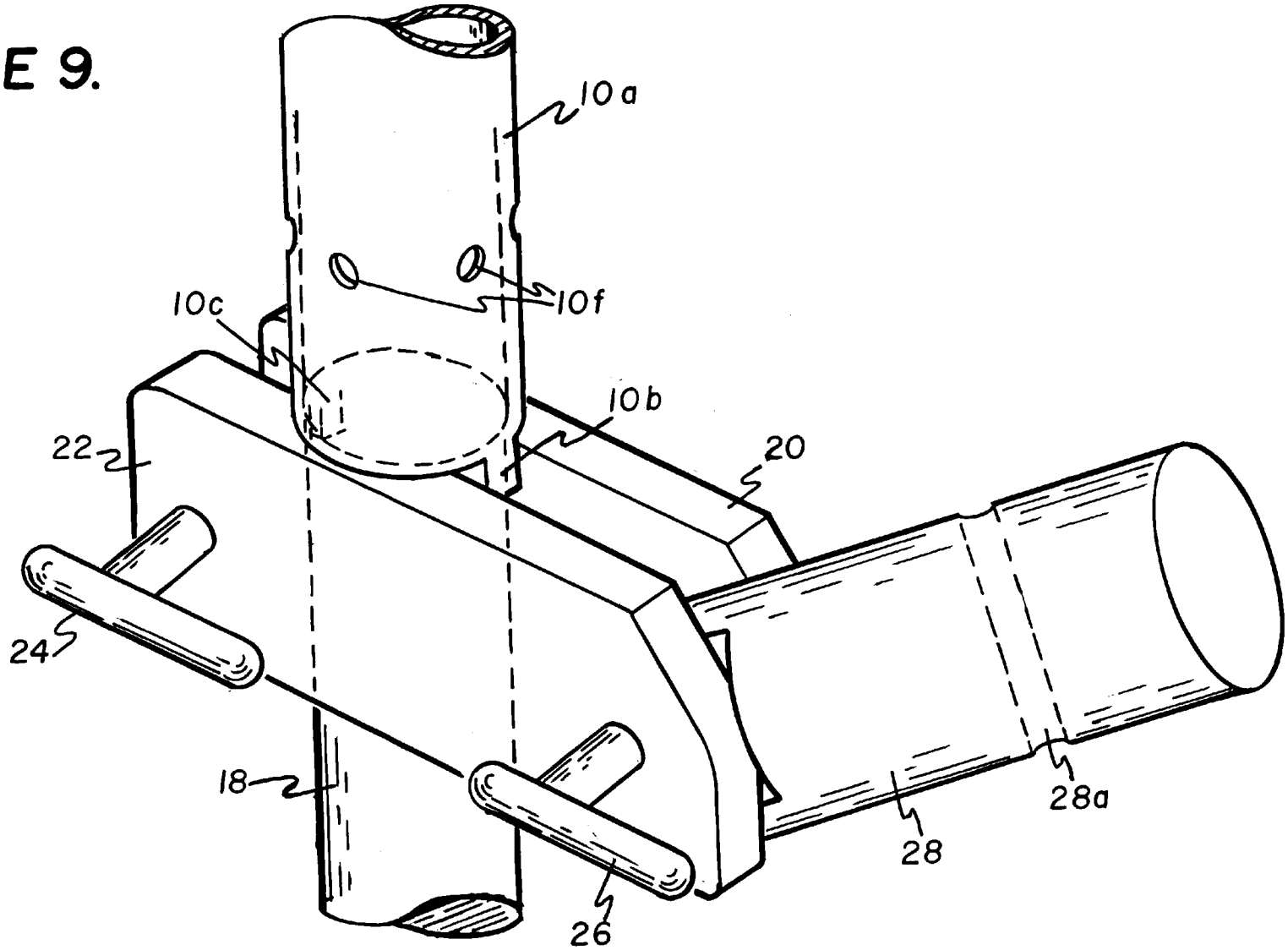
FIG. 9 is an isometric view showing details of the mounting bracket that affixes the main tube to the tow pylon of a ski boat.

The mounting bracket plates 20 and 22, and their hemicylindrical surfaces 20*a* and 22*a*, are sized and configured so that there is a gap between the plates 20 and 22 when they are clamped about the pylon 18. When the lower section 10*a* is slipped over the pylon 18, such that the main tube is in the upright extended pylon position, the lower end of the main tube 10 abuts the bracket 16. More particularly, the ears 10*b* and 10*c* of the lower section 10*a* of main tube 10 fit snugly in the gap between the plates 20 and 22 (FIG. 9), so that when the plates 20 and 22 are securely clamped to the pylon 18 and the main tube 10 is in the upright position, the main tube 10 is prevented from rotating around the pylon 18.

A pivotable, cylindrical male connector 28 extends from one end of the mounting bracket 16, and is pivotable about the L-bolt 26. The male connector 28 is of substantially the same diameter as that of the boat pylon 18, and is thus sized to fit snugly inside the open lower end of lower section 10*a*. The male connector 28 is pivotable in a vertical plane when the mounting bracket 16 is affixed to the pylon 18, so as to allow the main tube 10 to be alternately swung upward or lowered onto the gunnel of the boat.

A quick release pin 30 (FIG. 5) passes through opposing holes 10*f* in the lower section 10*a* of the main tube 10 and also through a diametrical bore 28*a* in the male connector 28, thereby affixing the main tube 10 to the male connector 28. The lower main tube section 10*a* includes 3 pairs of opposing holes 10*f*, which allow the main tube 10 to be rotated about the male connector 28 and to be affixed to the male connector 28 in any one of 3 positions. This allows the lower section 10*a* to be rotated about the male connector 28 when the main tube 10 is in the horizontally extended position. This rotational capability, taken with the diagonal section 10*d*, allows the main tube 10 to accommodate gunnels of different heights, and also allows the height of the main tube above the water to be adjusted, for example to accommodate skiers of different heights.

The extension rod 12 is a solid rod that is sized to slide telescopically within the upper section 10*e* of the main tube 10. The extension rod 12 permits the overall length of the apparatus to be adjusted as desired, either in the upright extended pylon position or in the horizontally extended boom position. A push-button locking plunger (not shown) allows the extension rod 12 to be fixed at various positions within the upper section 10*e* of the main tube 10.

The extension rod 12 includes an annular recess 12*a* at its outer end (FIG. 7), which is shaped to accept conventional water ski ropes. The extension rod 12 also includes an annular cable groove 12*b* located just inward from the annular recess 12*a*.

Figure 6:
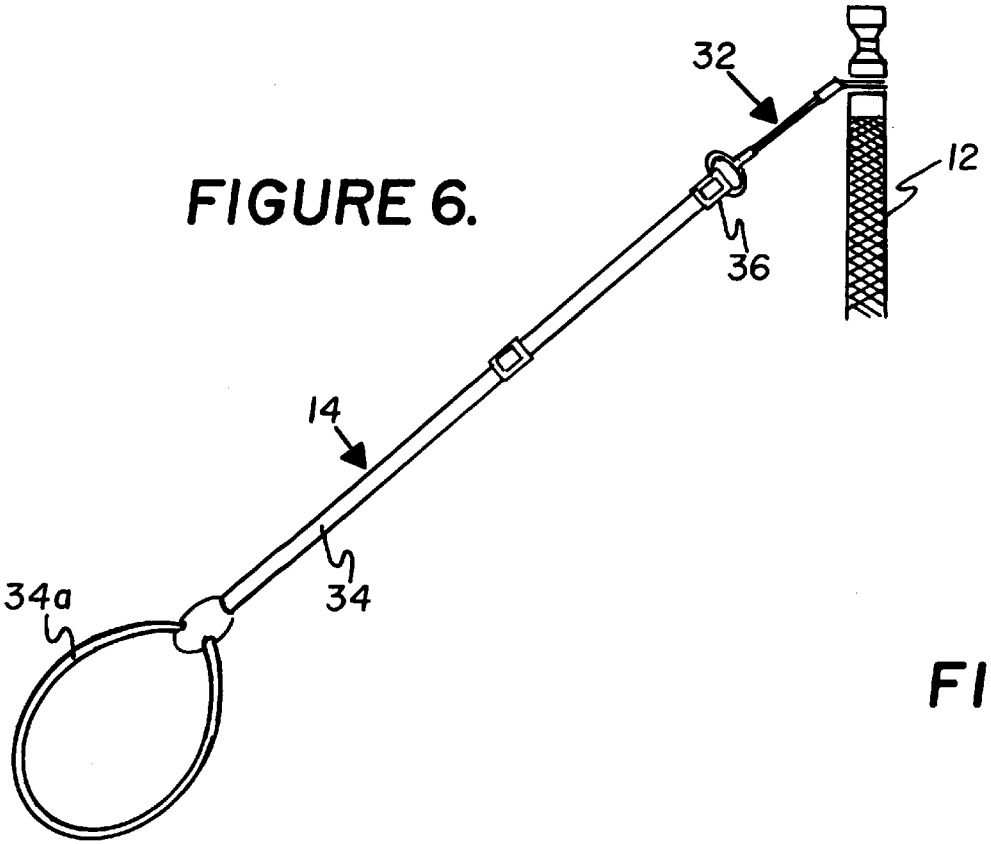
FIG. 6 illustrates details of the adjustable-tension cable and belt support rigging of the apparatus.
Figure 7:
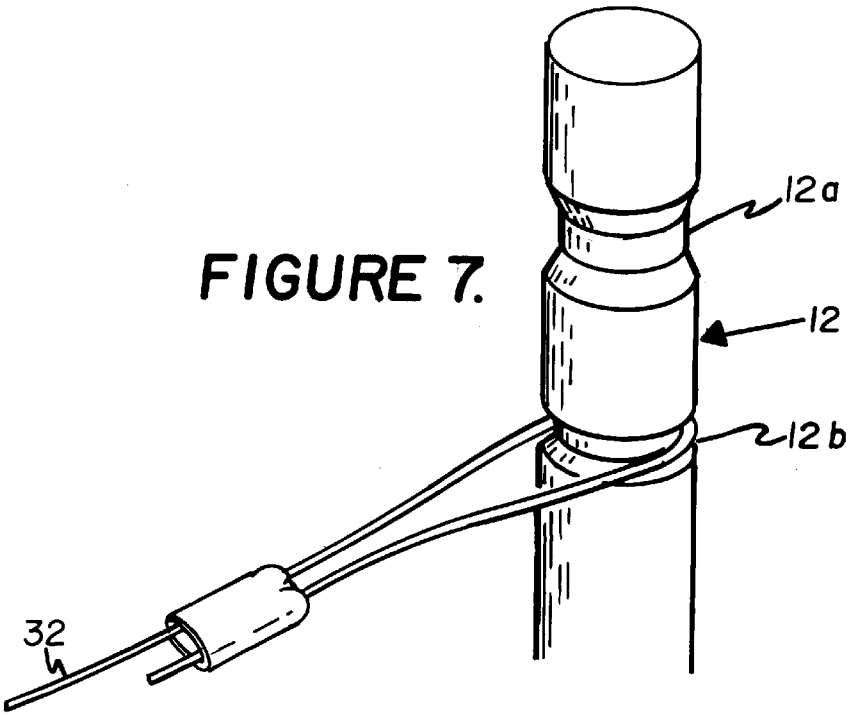
FIG. 7 illustrates details of the attachment of the cable and belt support rigging to the end of the main tube.
Figure 8:
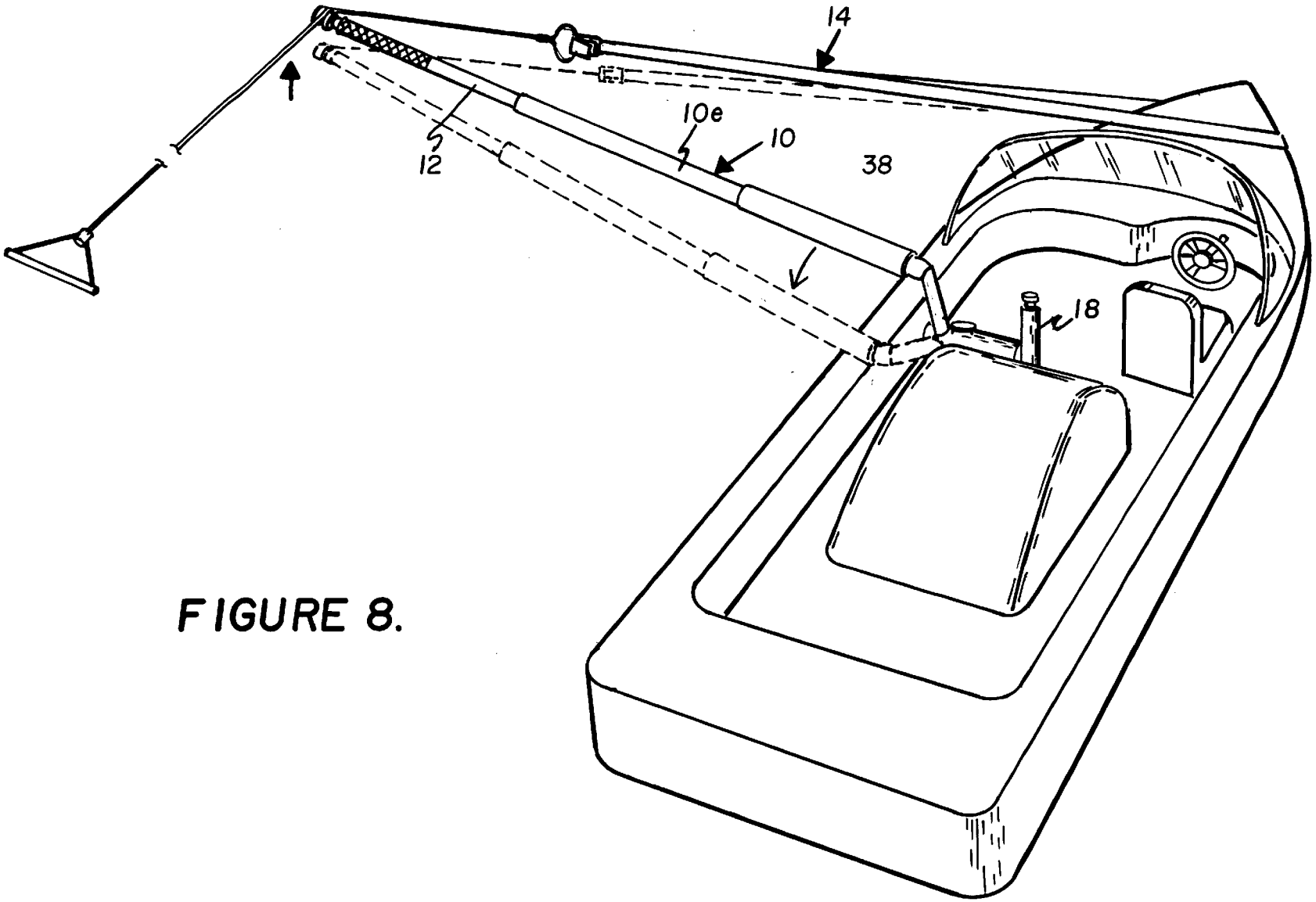
FIG. 8 illustrates the tow apparatus in the horizontally extended position, and further illustrates how the main tube can be both rotated to adjust for gunnels of differing heights, and swung both forwardly and rearwardly to obtain different angles with respect to the axis of the boat.

The support rigging 14 includes a short, covered steel cable 32 which is crimped in a loop that engages the cable groove 12*b* of the extension rod 12 (FIG. 6 and 7). At its opposite end the short steel cable 32 is attached to a length of nylon webbing 34 by means of quick adjust cam tightener 36.

The nylon webbing 34 ends in a large bow loop 34*a*, which is sized to encircle the bow of the boat. When the apparatus is in the upright position, as shown in FIGS. 2 or 3, the bow loop 34*a* encircles the bow of the boat and secures the main tube 10 and extension tube 12 against the rearward force imposed by a skier trailing the boat.

Figure 1:
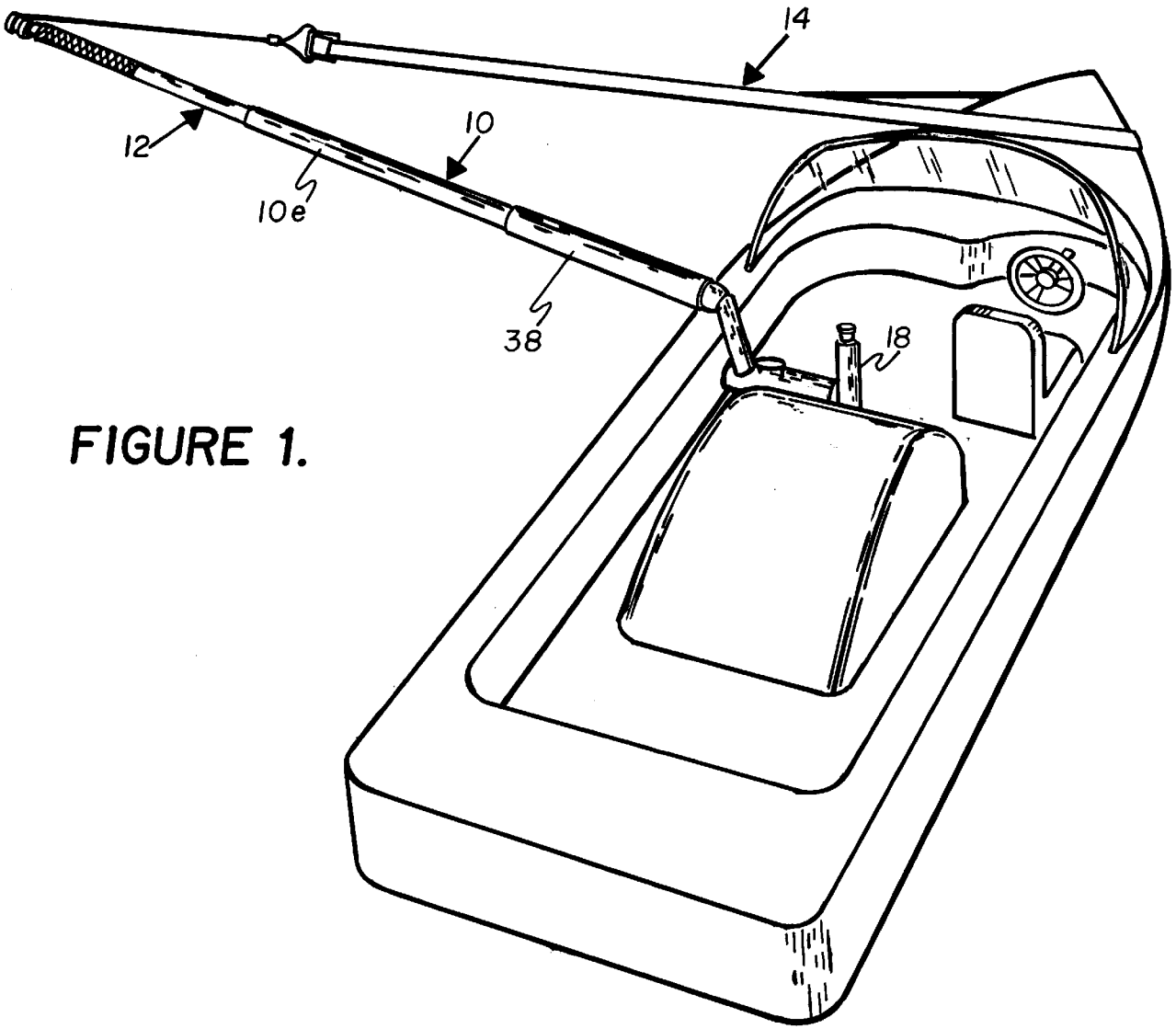
FIG. 1 illustrates the ski tow apparatus of the present invention, as installed in a ski boat and positioned in the horizontally extended position for training, barefoot skiing, other specialty applications.

When the apparatus is in the horizontally extended position, as shown in FIGS. 1 or 3, the bow loop 34*a* is secured to the bow eye of the boat, thereby securing the main tube against the rearward force imposed by a trailing skier.

The main tube 10 is provided with a polymeric protective sleeve 38, which functions to protect the gunnel of the boat.

It will be seen that the main tube 10 and extension tube 12 can be readily switched in the field from the upright position to the horizontally extending position by simply lifting the main tube 10 off the pylon 18, engaging it with the male connector 28 of the mounting bracket 16, and adjusting the rigging 14 accordingly. This offers the advantage of allowing multiple water ski activities to be practiced from a single boat, with little required in the way of equipment, tools, or specialized set up.

While the present invention has been described above by means of a preferred embodiment, it will be understood that various modifications, alterations and substitutions may be made by one of skill in the art, without departing from the essential invention. Accordingly, the scope of the present invention is defined by the following claims.

What is claimed is:

1. A convertible water ski tow apparatus for a boat having an upright ski tow pylon, comprising:

a main tube having an upper end and a lower end;

a mounting bracket;

support rigging;

said mounting bracket including means for securely affixing said mounting bracket to said upright ski tow pylon, and a male connector pivotably connected to said mounting bracket and extending therefrom so as to be pivotable in a vertical plane;

said lower end of said main tube being sized to slide over said pylon in a first position to engage said mounting bracket and to function as an upright extension of said pylon, and said male connector being sized to receive said lower end of said main tube in a second position so as to extend generally horizontally over the gunnel of the boat to function as a ski tow boom; and said support rigging extending from said upper end of said main tube to the bow of the boat, and being adjustable in tension and length so as to stabilize said main tube in either said first position or said second position against rearwardly directed forces imposed by a trailing water skier being towed by said main tube.

2. The convertible water ski tow apparatus defined in claim 1, wherein said main tube is offset along a portion of its length by an integral diagonal section to accommodate sun shades commonly used in ski boats when said main tube is said first position, and to permit adjustment of the main tube to gunnels of differing heights as well as the height of the main tube above the water when in said second position.

3. The convertible water ski tow apparatus defined in claim 1 wherein said main tube is engageable when in said first position with said mounting bracket so as to prevent rotation of said main tube relative to said pylon.

4. A convertible water ski tow apparatus for a boat having an upright ski tow pylon, comprising:

a main tube having an upper end and a lower end;

a mounting bracket;

support rigging;

said mounting bracket including a pair of opposing plates configured to securely engage said upright ski tow pylon and means for clamping said plates together about said pylon, and a male connector pivotably connected to said plates and extending therefrom;

said lower end of said main tube being sized to slide over said pylon in a first upright position to engage said mounting bracket and to function as an upright extension of said pylon, and said lower end of said main tube being sized to slide over said male connector in a second horizontal position so as to extend generally horizontally over the gunnel of the boat to function as a ski tow boom; and said support rigging extending from said upper end of said main tube to the bow of the boat, and being adjustable in tension so as to stabilized said main tube in either said first position or said second position against rearwardly directed forces imposed by a trailing water skier being towed by said main tube.

5. The convertible water ski tow apparatus defined in claim 4 wherein said lower end of said main tube is engageable with said mounting bracket by a pair of integral ears formed in said lower end of said main tube, said ears being sized to fit between said plates of said mounting bracket to prevent rotational motion of said main tube relative to said pylon.

6. The convertible water ski tow apparatus defined in claim 4 wherein said main tube is offset along a portion of its length by an integral diagonal section to accommodate sun shades commonly used in ski boats when said main tube is in the upright position, and to permit adjustment of the main tube to gunnels of differing heights as well as the height of the main tube above the water when in the horizontal position.

7. The convertible water ski tow apparatus defined in claim 5 wherein said main tube includes a plurality of opposing holes adjacent said lower end, and wherein said male connector includes a diametrical bore therethrough, and a quick release pin, where said main tube can be affixed to said male connector in a plurality of relative rotational positions, so as to allow said main tube to be adjusted to accommodate gunnels of varying heights, and to adjust the height of said main tube above the water when in said second horizontal position.

* * * * *